US010234793B2

(12) United States Patent
Okuyama et al.

(10) Patent No.: US 10,234,793 B2
(45) Date of Patent: Mar. 19, 2019

(54) DEVELOPMENT DEVICE USING A DRY ELECTROPHOTOGRAPHIC METHOD

(71) Applicant: CANON KABUSHIKI KAISHA, Tokyo (JP)

(72) Inventors: Yuta Okuyama, Kashiwa (JP); Tomoyuki Sakamaki, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/910,953

(22) Filed: Mar. 2, 2018

(65) Prior Publication Data

US 2018/0259881 A1 Sep. 13, 2018

(30) Foreign Application Priority Data

Mar. 9, 2017 (JP) ..... 2017-044775

(51) Int. Cl.

| | |
|---|---|
| ***G03G 15/09*** | (2006.01) |
| *G03G 15/01* | (2006.01) |
| *G03G 15/095* | (2006.01) |
| *G03G 15/08* | (2006.01) |

(52) U.S. Cl.

CPC ..... *G03G 15/0921* (2013.01); *G03G 15/0121* (2013.01); *G03G 15/0877* (2013.01); *G03G 15/095* (2013.01); *G03G 15/0907* (2013.01)

(58) Field of Classification Search

CPC ..... G03G 15/0921; G03G 15/0121; G03G 15/0877; G03G 15/095; G03G 15/0907

USPC ..... 399/277

See application file for complete search history.

(56) References Cited

U.S. PATENT DOCUMENTS

| | | | | |
|---|---|---|---|---|
| 6,668,147 | B2 * | 12/2003 | Ikeguchi | G03G 15/0921 399/267 |
| 7,203,450 | B2 * | 4/2007 | Kakegawa | G03G 15/0921 399/277 |

FOREIGN PATENT DOCUMENTS

| | | | | |
|---|---|---|---|---|
| EP | 1233312 | A2 * | 8/2002 | G03G 15/0921 |
| JP | H11161029 | A | 6/1999 | |
| JP | 2001005296 | A * | 1/2001 | |
| JP | 2003057953 | A * | 2/2003 | G03G 15/0921 |
| JP | 2004170555 | A | 6/2004 | |
| JP | 2004271876 | A * | 9/2004 | G03G 15/0921 |
| JP | 2005189811 | A * | 7/2005 | G03G 15/0921 |
| JP | 2006293277 | A | 10/2006 | |
| JP | 2007310340 | A | 11/2007 | |
| JP | 2010061064 | A * | 3/2010 | G03G 15/0928 |

* cited by examiner

*Primary Examiner* — Susan S Lee
(74) *Attorney, Agent, or Firm* — Canon U.S.A., Inc. IP Division

(57) ABSTRACT

A development device includes a magnetic field generation unit having a developing magnetic pole S2, a magnetic pole N2, and a magnetic pole N1. The magnetic poles N2 and N1 are disposed adjacent to the magnetic pole S2, at positions downstream and upstream of the magnetic pole S2 in a rotation direction of a sleeve, respectively. The magnetic pole N2 is configured to have a larger magnetic flux density and full width half maximum in a normal direction of the sleeve and have a smaller inter-pole distance from the developing magnetic pole than the magnetic pole N1, so that the rising position of magnetic brushes of developer is shifted in the upstream direction, and the magnetic brushes come into contact with a photosensitive drum more suitably.

6 Claims, 7 Drawing Sheets

EXEMPLARY EMBODIMENT 1

COMPARATIVE EMBODIMENT 1

DEVELOPMENT DEVICE USING A DRY ELECTROPHOTOGRAPHIC METHOD

BACKGROUND

Field of the Disclosure

The present disclosure relates to a development device used in an image forming apparatus such as a coping machine or a laser beam printer using a dry electrophotographic method.

Description of the Related Art

In an image forming apparatus such as a coping machine using an electrophotographic method, charged toner is brought close to a photosensitive drum serving as a latent image bearing member, which will simply be referred to as a drum. By electrostatically attaching the toner to the electrostatic latent image on the drum, the toner is developed, and an image is consequently formed. Other than development devices that use one-component developer including magnetic toner as developer, development devices that use two-component developer in which non-magnetic toner and magnetic carriers are mixed are used in many cases. Since development using two-component developer is excellent in stability of the toner charge amount, color images having excellent color tone can be formed by the two-component method. Thus, the two-component developer can be suitably used in color image forming apparatuses.

In the development method using two-component developer, a magnetic field generation unit fixedly disposed inside a development sleeve enables the development sleeve to bear developer, and magnetic carriers form magnetic brushes along lines of the magnetic force generated by the magnetic field generation unit. When the development sleeve conveys the developer to an area near the drum, the magnetic brushes come into contact with the drum. Next, by way of the area where the development sleeve and the drum are the closest to each other, the magnetic brushes are detached from the drum. This area where the magnetic brushes and the drum are into contact with each other until the magnetic brushes is detached from the drum is called a contact nip, and the toner is mainly attached to the drum by the force of the electric field generated by the potential difference between the development sleeve and the electrostatic latent image on the drum at this contact nip area. As a result, a toner image is formed.

For example, Japanese Patent Application Laid-Open No. 2006-293277 discusses a development technique in which two-component developer is used and magnetic brushes are brought into contact with a drum.

In a two-component developer development method, it is important to increase the toner development amount per potential difference between the exposure potential on the drum and the development sleeve. Namely, it is important to increase the development efficiency. If the development efficiency is low, to achieve a sufficient image density, the toner development amount needs to be increased further by increasing the potential difference between the exposure potential and the development sleeve, namely, by increasing the electric field strength.

However, if the electric field strength is excessively increased, a phenomenon occurs in which carriers in the two-component developer are attached to an image portion along with toner (carrier attachment to image portion). The carriers attached to an image portion could hinder the transfer of the toner and cause a white spot on an image. Thus, it is necessary to increase the toner develop amount without increasing the electric field strength.

In a contact development method using the two-component developer, how magnetic brushes come into contact with the drum at the contact nip is highly related to the development amount. When the area where the drum and the development sleeve are close to each other was observed with a high-speed camera (FASTCAM SA5 manufactured by Photron Limited) from their cross-sectional direction, the following findings were obtained.

FIG. 7 illustrates a result of the observation, which indicates how magnetic brushes of magnetic carriers of developer come into contact with the drum at the contact nip area. In FIG. 7, arrows indicate rotation directions of the drum and the development sleeve. At a position upstream in the rotation direction of the development sleeve, ends of magnetic brushes come into contact with the drum as they are inclined in the direction opposite to the rotation direction of the development sleeve. This prevents the subsequent magnetic brushes from coming into contact with the drum, and furthermore, this inclination of magnetic brushes prevents toner from flying to the drum. Consequently, the development efficiency is decreased.

SUMMARY

The present disclosure is directed to a development device having improved development efficiency.

According to an aspect of the present disclosure, a development device that develops an electrostatic latent image formed on an image bearing member includes a developer bearing rotatable member configured to bear and convey developer, and a magnetic field generation unit configured to include a first magnetic pole that is fixedly disposed inside the developer bearing member at a position facing the image bearing member, a second magnetic pole that is disposed adjacent to the first magnetic pole at a position upstream of the first magnetic pole in a rotation direction of the developer bearing member and that has a magnetic polarity different from the first magnetic pole, and a third magnetic pole that is disposed adjacent to the first magnetic pole at a position downstream of the first magnetic pole in the rotation direction of the developer bearing member and that has a magnetic polarity different from the first magnetic pole, wherein a maximum value and a full width half maximum of a magnetic flux density of the third magnetic pole in a normal direction of the developer bearing member are larger than a magnetic flux density of the second magnetic pole in the normal direction of the developer bearing member, and wherein a distance between the third magnetic pole and the first magnetic pole is smaller than that between the second magnetic pole and the first magnetic pole.

Further features of the present disclosure will become apparent from the following description of exemplary embodiments with reference to the attached drawings.

DESCRIPTION OF THE EMBODIMENTS

Hereinafter, embodiments of the present disclosure will be described in detail with reference to drawings.

(1) Image Forming Portion

Figure 4:
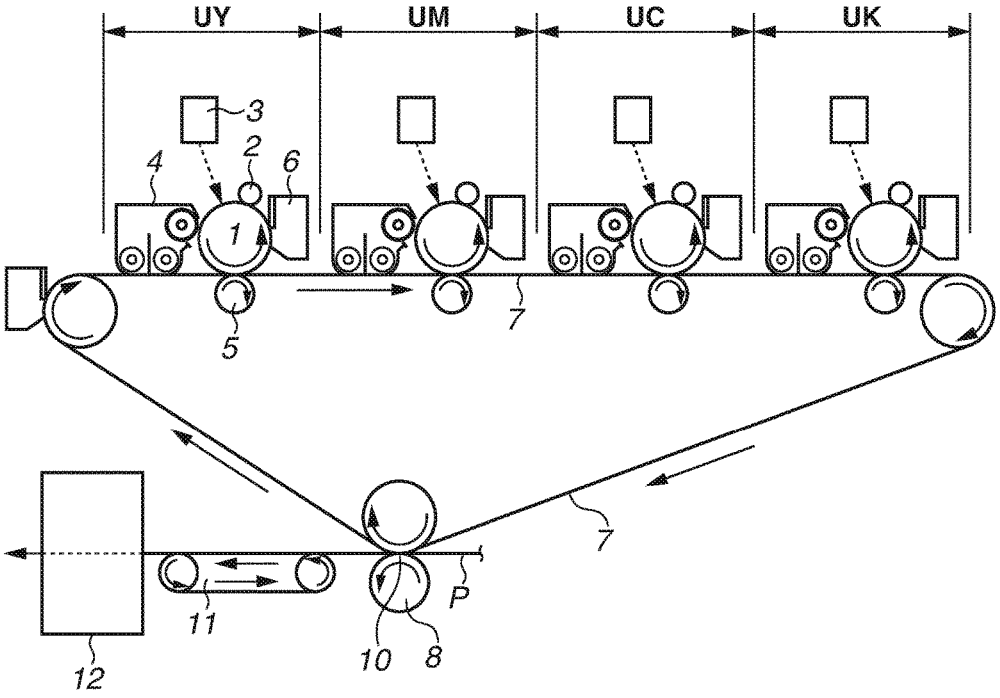
FIG. 4 illustrates a schematic configuration of an image forming portion of an image forming apparatus, according to an embodiment of the subject disclosure.

Hereinafter, a first exemplary embodiment will be described. FIG. 4 illustrates a schematic configuration of an image forming portion of an image forming apparatus according to the present exemplary embodiment. The image forming apparatus according to the present exemplary embodiment is a tandem-type full-color (four-color) printer using a transfer-type electrophotographic process.

The image forming portion includes four image forming units (drum cartridges: image forming stations) UY, UM, UC, and UK, which form toner images of four colors of yellow (Y), magenta (M), cyan (C), and black (K), respectively. Each of the image forming units is an electrophotographic mechanism that uses toner of a different color. In addition, each of the image forming units includes a photosensitive drum 1, which will simply be referred to as a drum 1 serving as a latent image bearing member, a charging device 2, a laser scanner 3, a development device (developing device) 4, a primary transfer roller 5, and a cleaner 6.

To avoid complexity in FIG. 4, the reference characters of the components of the image forming units UM, UC, and UK other than the image forming unit UY are not shown. In addition, since the image forming operation performed by these image forming units is publicly known, the description thereof will be omitted.

The rotating drums 1 in the respective image forming units UY, UM, UC, and UK sequentially superimpose toner images of the respective colors in a predetermined manner on a rotating intermediate transfer belt 7. In this way, primary transfer is performed. As a result, a color toner image in which the toner images of the four colors of Y, M, C, and K have been superimposed is formed on the belt 7.

On the other hand, a recording material (paper) P as a recording medium is conveyed from a recording material feeding unit (not illustrated) to a secondary transfer portion 10 where the belt 7 and secondary transfer rollers 8 are placed in contact with each other, and batch secondary transfer processing of the four-color toner image is sequentially performed from the belt 7 on the recording material P. After passing through the secondary transfer portion 10, the recording material P is conveyed to a fixing device 12 by a conveyance device 11. At the fixing device 12, the recording material P is heated and pressed. Namely, the toner image on the recording material P undergoes fixing processing. Finally, the recording material P is discharged to the outside of the image forming apparatus as a medium on which a color image has been formed.

(2) Development Device

Figure 2:
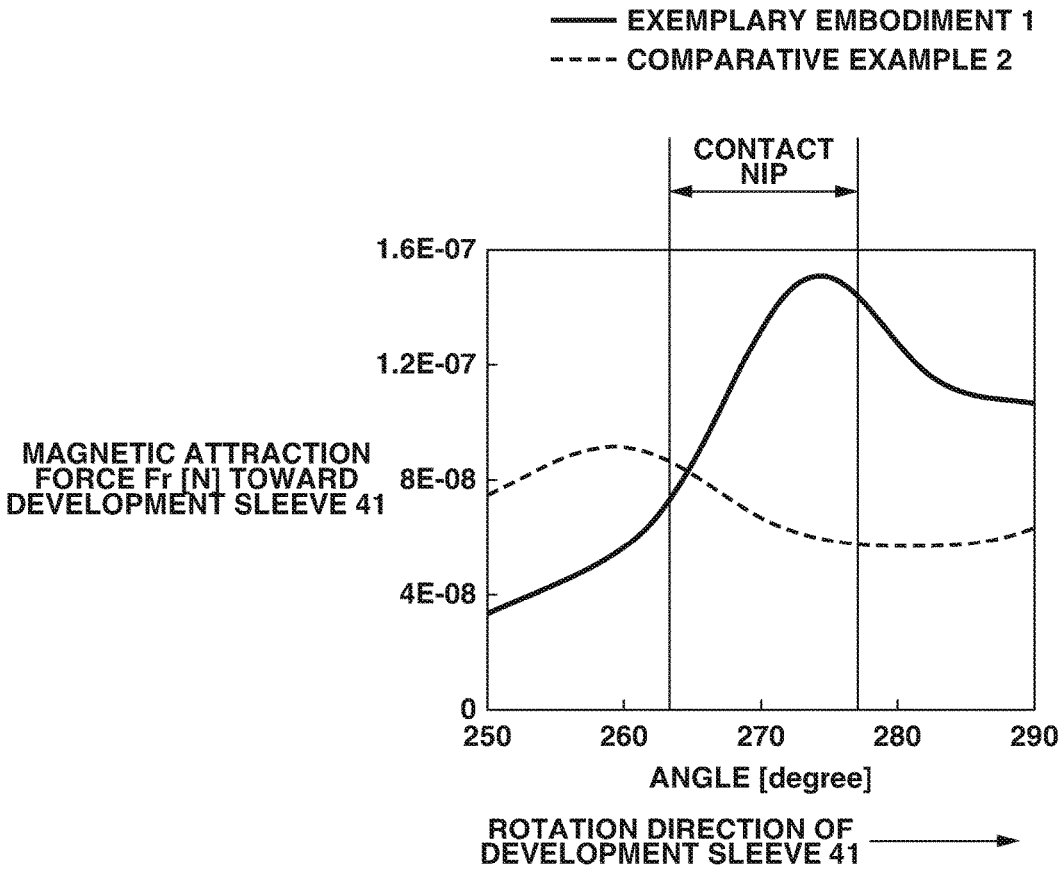
FIG. 2 illustrates magnetic attraction forces Fr according to the first exemplary embodiment and comparative example 2.
Figure 3A:
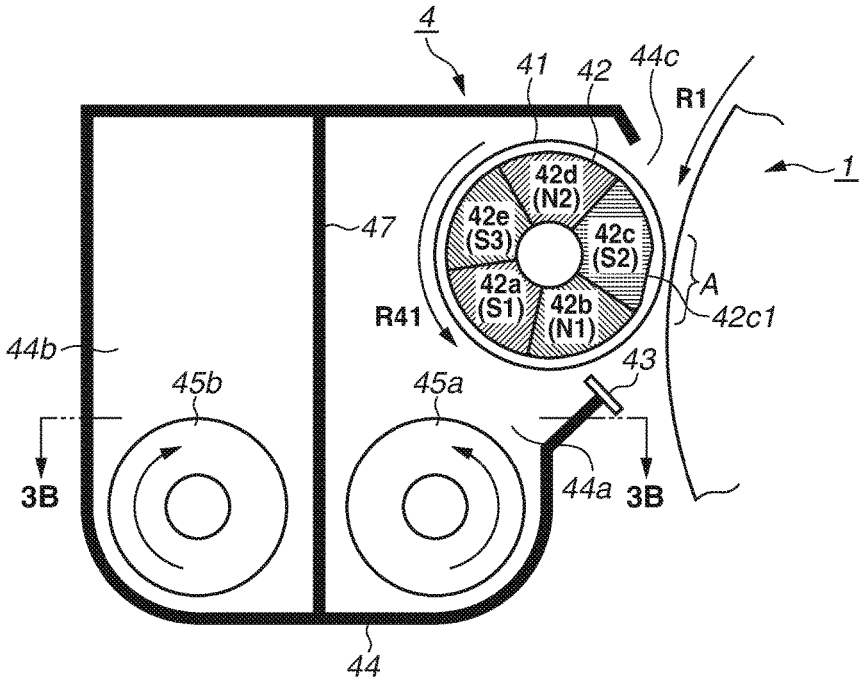
FIG. 3A is a schematic cross section of the development device according to the first exemplary embodiment.
Figure 3B:
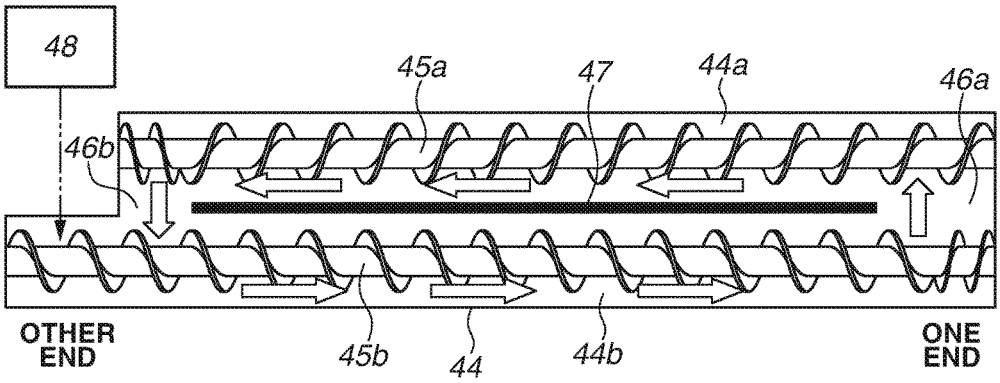
FIG. 3B is a schematic cross section taken along line (b)-(b) in FIG. 3A.

FIG. 3A is a schematic cross section of the development device 4, and FIG. 3B is a schematic cross section taken along line (b)-(b) in FIG. 3A. The development device 4 is a horizontally long device whose longitudinal direction is in parallel to the rotation axis of the drum 1. The development device 4 applies two-component developer including non-magnetic toner and magnetic carriers to the rotatable drum 1 on which a latent image has been formed, so that a latent image is developed as a toner image. The development device 4 includes a development container 44 and a hollow (cylindrical) development sleeve 41, which will simply be referred to as a sleeve. The development container 44 contains developer, and the sleeve 41 is rotatably installed, and serves as a developer bearing member for conveying developer to a development area A, which faces the drum 1. The developer is not illustrated in FIG. 2.

The development container 44 has a slit-like opening 44*c* arranged in the longitudinal direction of the development container 44 at a position corresponding to the development area A facing the drum 1. The sleeve 41 is rotatably disposed so that a part of the sleeve 41 is exposed in the opening 44*c* in the direction of the drum 1. The rotation axis of the sleeve 41 is substantially in parallel to the rotation axis of the drum 1, and the sleeve 41 faces the drum 1 in a non-contact manner at a predetermined distance from the drum 1.

A magnet roller 42 serving as a magnetic field generation unit that does not rotate and has a plurality of magnetic poles is fixed inside the sleeve 41. The sleeve 41 rotates around the periphery of this fixed magnet roller 42 at a predetermined peripheral velocity in the direction indicated by an arrow R41.

The inside of the development container 44 is partitioned by a wall 47, which extends in the vertical direction and the longitudinal direction of the development container 44, into a development chamber 44*a* including the sleeve 41 and an agitation chamber 44*b* opposite to the sleeve 41. The development chamber 44*a* is a functional chamber that supplies developer to the sleeve 41. The agitation chamber 44*b* is a functional chamber that receives and agitates developer collected from the sleeve 41 and supplied replenishment toner.

A first communication portion 46*a* in which the development chamber 44*a* and the agitation chamber 44*b* communicate with each other is arranged at one end of the development chamber 44*a* and of the agitation chamber 44*b* in the longitudinal direction of the sleeve 41. In addition, a second communication portion 46*b* in which the development chamber 44*a* and the agitation chamber 44*b* communicate with each other is arranged at the other end of the development chamber 44*a* and of the agitation chamber 44*b* in the longitudinal direction of the sleeve 41.

In addition, the development chamber 44*a* and the agitation chamber 44*b* include first and second screws 45*a* and 45*b* serving as developer conveyance members, respectively. The first screw 45*a* and the second screw 45*b* convey the developer in the respective development chamber 44*a* and agitation chamber 44*b*. More specifically, the first and second screws 45*a* and 45*b* allow the developer to circulate as indicated by white arrows in FIG. 3B (development chamber 44*a*→first communication portion 46*a*→agitation chamber 44*b*→second communication portion 46*b*→development chamber 44*a*).

In the present exemplary embodiment, a toner replenishment portion 48 that replenishes the agitation chamber 44*b* with replenishment toner is disposed at the other end of the agitation chamber 44*b*. The first screw 45*a* agitates and conveys the developer inside the development chamber 44*a*. The second screw 45*b* agitates and conveys the toner supplied from the toner replenishment portion 48 and the developer inside the agitation chamber 44*b*, to achieve a uniform toner concentration.

The development container side of the sleeve 41 faces the development chamber 44*a*. When the first screw 45*a* in the development chamber 44*a* rotates and conveys the developer in the development chamber 44*a*, the developer rises (moves upward) to supply the developer to the sleeve 41. Since the developer includes magnetic carriers, the developer near the sleeve 41 is locked by the magnetic force generated by the magnet roller 42 in the sleeve 41 and borne on the surface of the sleeve 41 as a developer layer.

As the sleeve 41 rotates, the developer on the sleeve 41 passes through a gap portion between a regulation member (developer layer thickness regulation member) 43 and the sleeve 41. The regulation member 43 is fixed to the development container 44 and maintains a predetermined gap between its end portion facing the sleeve 41 and the sleeve 41. In this way, the amount of the developer on the sleeve 41 is regulated to become a predetermined suitable amount. The developer is conveyed in the regulated amount by subsequent rotation of the sleeve 41 to the development area A facing the drum 1, which rotates in the direction indicated by an arrow R1. The developer is applied to the drum 1 at the development area A. As a result, the latent image on the drum 1 is developed by the developer toner as a toner image.

The developer, which has passed by the development area A, is conveyed back into the development container 44 by the subsequent rotation of the development sleeve 41 and is detached from the sleeve 41 by the peeling magnetic field formed by the repulsive magnetic poles 42*e* and 42*a* of the magnet roller 42. After the developer is detached from the sleeve portion, the developer inside the development chamber 44*a* is newly supplied and borne on the sleeve.

In the present exemplary embodiment, the developer contained in the development container 44 is two-component developer in which negative-charge-type non-magnetic toner and magnetic carriers are mixed. The non-magnetic toner is powder obtained by including a coloring material, a wax component, etc. in resin such as polyester or styrene and by performing grinding or polymerization. The magnetic carriers are obtained by performing resin coating on surface layers of cores formed from resin particles obtained by kneading ferrite particles and magnetic powder.

Next, a development process of toner onto the drum 1 at the development area A will be described. After the drum 1 is uniformly charged at a charging potential Vd [V] by the charging device 2, an image portion is exposed by the laser scanner 3 to have an exposure potential Vl [V].

A direct-current (DC) voltage or a voltage obtained by superimposing an alternating-current (AC) voltage on a DC voltage is applied to the sleeve 41. Where the DC voltage of the sleeve 41 is Vdc, an absolute value of the difference |Vdc−Vl| between the DC voltage Vdc and the exposure potential Vl is referred to as a voltage Vcont. This voltage Vcont forms the electric field that conveys toner to the image portion. In addition, an absolute value of the difference |Vdc−Vd| between the DC voltage Vdc and the charging potential Vd is referred to as a voltage Vback, and this voltage forms the electric field that detaches toner from the drum 1 back to the sleeve 41. This electric field is formed to prevent the fogging phenomenon in which toner is attached to non-image portions.

Next, a detailed configuration of the magnet roller 42 serving as the magnetic field generation unit will be described. The magnet roller 42 used in the present exemplary embodiment includes first to fifth magnet pieces 42*a* to 42*e*, which will simply be referred to as pieces.

The sleeve 41 rotates in the direction indicated by the arrow R41 in FIG. 3, and the developer absorbed on a position corresponding to a drawing magnetic pole S1 formed around the first piece 42*a* is conveyed in the direction of the regulation member 43. Next, the layer thickness of the developer raised up by a regulating magnetic pole N1 formed around the second piece 42*b* is regulated by the regulation member 43. In this way, after passing through the gap between the sleeve 41 and the regulation member 43, the developer layer has a predetermined layer thickness on the sleeve 41.

Next, the developer layer is borne and conveyed to the development area A facing the drum 1. Magnetic brushes of magnetic carriers are formed by a developing magnetic pole S2 formed around the third piece 42*c*. The magnetic brushes develop the electrostatic latent image on the surface of the drum 1.

After being used for the development, the developer passes by way of a conveying magnetic pole N2 formed around the fourth piece 42*d* and is detached from the sleeve 41 in a peeling area (peeling magnetic field) formed by the repulsion between the peeling magnetic pole S3 formed by the fifth piece 42*e* and the drawing magnetic pole S1.

In the development device 4 according to the present exemplary embodiment, with respect to the two magnetic poles N2 and N1 adjacent to the developing magnetic pole S2, the upstream regulating magnetic pole N1 has a different magnetic polarity from the drawing magnetic pole S1 located further upstream thereof.

(2) Characteristics in the Present Exemplary Embodiment

Figure 1A:
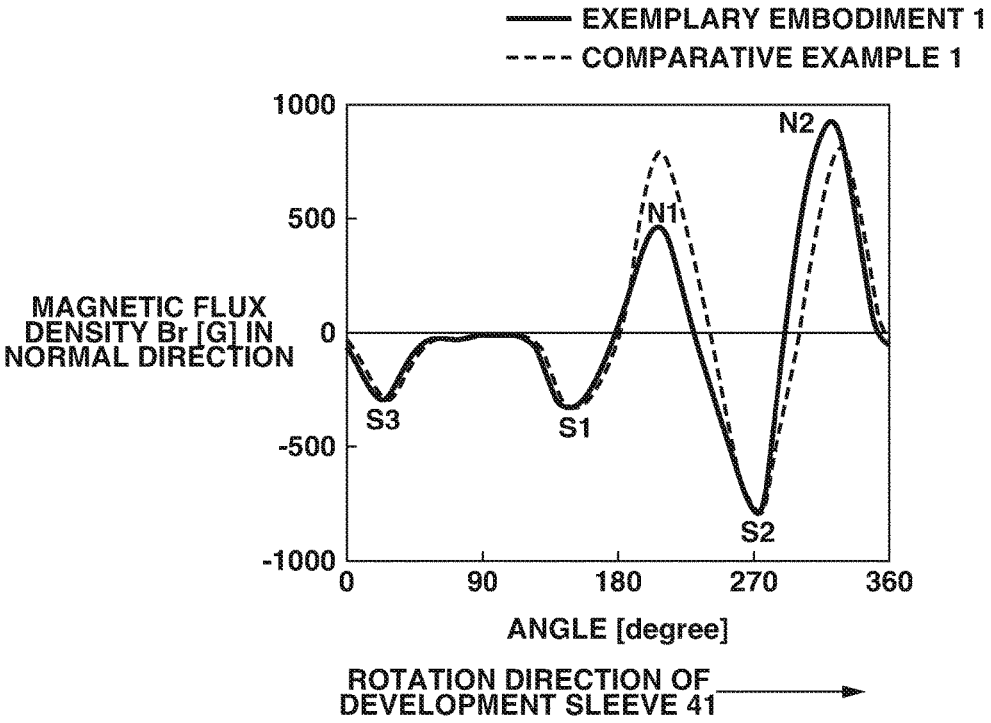
FIGS. 1A to 1C illustrate magnetic flux densities of development devices according to a first exemplary embodiment and comparative example 1.

A magnetic flux density Br formed by the above pieces 42*a* to 42*e* in the normal direction of the sleeve 41 is indicated by a solid line in FIG. 1A. The magnetic flux density Br was measured by using a magnetic field measuring instrument "MS-9902" (product name) manufactured by F.W.BELL Inc. In this measurement, the distance between a probe, which is a member of the measuring instrument, and the surface of the sleeve 41 was set to about 100 μm.

Between the magnetic poles N1 and N2 adjacent to the developing magnetic pole S2, the conveying magnetic pole N2 downstream in the rotation direction of the sleeve 41 has a larger magnetic flux density Br and a larger full width half maximum than the upstream regulating magnetic pole N1. Unless otherwise stated, "upstream" and "downstream" refer to locations in the rotation direction of the sleeve 41. The "full width half maximum" refers to the width of the magnetic flux density Br at a position corresponding to a half value of the maximum value of the magnetic pole.

In addition, unlike the other four pieces 42*a*, 42*b*, 42*d*, and 42*e*, a part of the outer periphery of the third piece 42*c* formed around the developing magnetic pole S2 has a flat shape 42*c*1, as illustrated in FIG. 3A. Owing to this shape 42*c*, the magnetic flux density Br of the developing magnetic pole S2 gradually changes on its upstream side and sharply changes on its downstream side. That is, the developing magnetic pole S2 exhibits strong anisotropy between its upstream and downstream sides when the maximum value is used as a reference.

More specifically, the maximum value of the magnetic flux density Br formed by the developing magnetic pole S2 in a normal direction of the sleeve 41 is located downstream of the center position of the corresponding full width half maximum in the rotation direction of the sleeve 41. Because of this anisotropic shape of the magnetic flux density Br, the developing magnetic pole S2 has a small inter-pole angle (inter-peak angle: inter-pole distance) from the conveying magnetic pole N2.

The above configuration will be summarized as follows: Between the two magnetic poles N2 and N1, which are located downstream and upstream of the developing magnetic pole S2 in the rotation direction of the sleeve 41, the maximum value and the full width half maximum of the magnetic flux density Br of the downstream magnetic pole N2 in the normal direction of the sleeve 41 are larger than the upstream magnetic pole N1. In addition, the inter-pole distance between the downstream magnetic pole N2 and the developing magnetic pole S2 is smaller than that between the upstream magnetic pole N1 and the developing magnetic pole S2.

As comparative example 1, a case is illustrated by a dashed line in FIG. 1A, in which the conveying magnetic pole N2 and the regulating magnetic pole N1 have approximately the same magnetic flux density Br, full width half maximum, and inter-pole angle from the developing magnetic pole S2. Table 1 presents the magnetic flux densities Br, the full width half maximum, and the inter-pole angles from the developing magnetic pole S2 of the conveying magnetic pole N2 and the regulating magnetic pole N1 according to the present first exemplary embodiment and comparative example 1.

TABLE 1

| | exemplary embodiment 1 | | comparative example 1 | |
|---|---|---|---|---|
| | regulating magnetic pole N1 | conveying magnetic pole N2 | regulating magnetic pole N1 | conveying magnetic pole N2 |
| magnetic flux density [G] | 468 | 925 | 794 | 803 |
| full width half maximum [°] | 41.5 | 31.8 | 35.1 | 34.3 |
| inter-pole angle [°] | 49.1 | 66.3 | 61.2 | 58.3 |

Figure 1B:
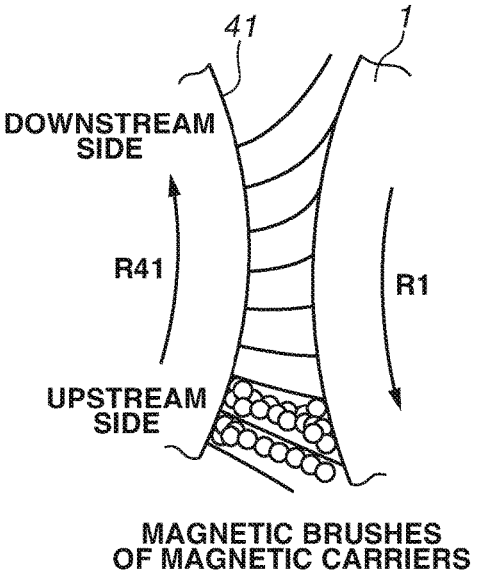
Figure 1C:
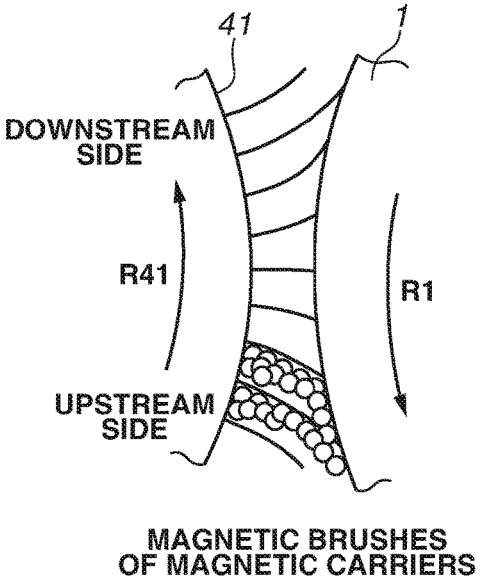

FIGS. 1B and 1C illustrate lines of magnetic force generated by magnetic poles according to the first exemplary embodiment and comparative example 1, respectively.

With the configuration according to comparative example 1, since the regulating magnetic pole N1 and the conveying magnetic pole N2 that are adjacent to the developing magnetic pole S2 have approximately the same magnetic flux density, full width half maximum, and inter-pole angle from the developing magnetic pole S2, the lines of magnetic force are symmetrical with reference to the position where the drum 1 faces the sleeve 41.

In contrast, according to the first exemplary embodiment, since the conveying magnetic pole N2 has a larger magnetic flux density and full width half maximum and a smaller inter-pole angle from the developing magnetic pole S2 than the regulating magnetic pole N1, more lines of magnetic force flow from the conveying magnetic pole N2. Therefore, as illustrated in FIG. 1B, the position where lines of magnetic force flow perpendicular to the sleeve 41 is located upstream of the contact area in the rotation direction of the sleeve 41.

Further, the orientation of magnetic brushes of magnetic carriers of the developer depends on the lines of magnetic force generated by a corresponding magnetic pole. In comparative example 1 in FIG. 3C, at the area where magnetic brushes start to come into contact with the drum 1, since ends of the magnetic brushes are inclined in the opposite direction to a rotation direction R41 of the sleeve 41, the contact of the subsequent magnetic brushes with the drum 1 and the flying of the toner to the drum 1 are hindered. Thus, the development is deteriorated.

In contrast, according to the first exemplary embodiment in FIG. 1B, ends of the magnetic brushes come into contact with the drum 1, being inclined in the rotation direction R41 of the sleeve 41. Thus, the magnetic brushes suppress the flying of the toner and the development can be performed more efficiently.

Improvement of the development efficiency by the drum 1 and the magnetic brushes that are brought into contact with each other can also be achieved in a different way. For example, improvement of the development efficiency can be achieved by using the magnetic pole pattern according to comparative example 1 and by disposing the developing magnetic pole S2 at a more upstream position. More specifically, improvement of the development efficiency can be achieved by rotating the magnet roller serving as the magnetic field generation unit according to comparative example 1 in a direction opposite to the rotation direction R41 of the sleeve 41 by a few degrees and fixing the magnet roller at that position.

However, if this means is employed, carriers are attached to non-image portions. This is a phenomenon in which carriers, which have been positively charged by friction with toner, are attached to the drum 1 by the force (Vback) of the static electric field of non-image portions. These attached carriers are transferred onto the intermediate transfer belt 7, and transfer of toner in downstream image forming units is hindered. As a result, poor-quality images such as images with white spots could be formed.

The attachment of carriers to non-image portions is closely related to the magnetic attraction force Fr that draws the developer toward the center of the sleeve 41. The magnetic attraction force Fr can be expressed by the following expression.

$$F_r = \frac{\mu - \mu_0}{\mu_0(\mu + 2\mu_0)} 2\pi b^3 \left( B_r \frac{\partial B_r}{\partial r} + B_\theta \frac{\partial B_\theta}{\partial r} \right) \quad \text{expression 1}$$

In the expression 1, $\mu$ denotes a magnetic permeability of magnetic carriers, $\mu_0$ denotes a magnetic permeability of free space, and b denotes a radius of magnetic carriers. $B\theta$ is obtained from the following expression by using the value of the magnetic flux density Br measured by the above method.

$$B_\theta = -\frac{\partial A_z(r, \theta)}{\partial r} \left( A_z(R, \theta) = \int_0^\theta R B_r d\theta \right) \quad \text{expression 2}$$

The magnetic attraction force Fr around the contact nip area according to the present exemplary embodiment is indicated in a solid line in FIG. 2. In addition, as comparative example 2, the magnetic attraction force Fr, which is generated when the magnet roller serving as the magnetic field generation unit according to comparative example 1 is rotated in a direction opposite to the rotation direction of the sleeve 41 by 8 degrees and is fixed at that position, is indicated in a dashed line in FIG. 2. The contact nip area in FIG. 2 is the area where toner is attached to the drum 1 when the DC voltage Vcont=300 [V] is applied to the sleeve 41 while the drum 1 and the sleeve 41 are stopped.

In the configuration according to comparative example 2, the area where the magnetic attraction force Fr is strong is outside the contact nip area. Thus, in the contact nip area, the magnetic attraction force Fr is weak. More specifically, since the force that draws the carriers in the direction of the center of the sleeve 41 is weak, carriers are easily attached to non-image portions.

In contrast, according to the first exemplary embodiment, since the magnetic attraction force Fr in the contact nip area is strong and has a peak at an angle in a downstream side in the rotation direction of the sleeve 41, carriers are not easily attached.

Table 2 illustrates development efficiencies and how many carriers have been attached per square centimeter ($cm^2$) when the systems according to the first exemplary embodiment and comparative examples 1 and 2 are employed. The "development efficiency" is a value obtained by dividing the surface potential of the toner layer attached to the drum 1 after completion of the development process, by a development contrast, in other words, (surface potential of the drum 1 after development)/Vcont×100. The number of attached carriers is obtained by determining the number of carriers attached onto the drum 1 in a blank copy image (non-image portion) of 10 $cm^2$.

In addition, as development conditions, the charging potential Vd, the exposure potential Vl, and the development bias DC voltage Vdc are set so that the voltage Vcont=300 [V] and the voltage Vback=150 [V]. Further, the AC component in the form of a rectangular wave having a peak-to-peak voltage of 1.3 kV and a frequency of 10 kHz is superimposed on the development bias.

TABLE 2

| | exemplary embodiment 1 | comparative example 1 | comparative example 2 |
|---|---|---|---|
| development efficiency [%] | 99 | 92 | 101 |
| number of carriers attached [per $cm^2$] | 0.2 | 1.1 | 3.7 |

Comparative example 1 achieves a lower development efficiency than the first exemplary embodiment. This is because the contact with the drum 1 is not optimized, so that the development is hindered. Further, according to comparative example 2, while the development efficiency is improved, many more carriers are attached. This is because the developing magnetic pole S2 has been rotated in the upstream direction, so that the magnetic attraction force Fr at the contact nip area has become weak.

In contrast, if the configuration according to the first exemplary embodiment is employed, the development efficiency can be improved while preventing the attachment of carriers.

Next, a second exemplary embodiment will be described. While a development device 4 according to the second exemplary embodiment has basically the same configuration as the development device 4 according to the first exemplary embodiment, the magnetic pole pattern of a magnet roller 42 serving as a magnetic field generation unit and the functions of the individual magnetic poles are different.

Figure 5:
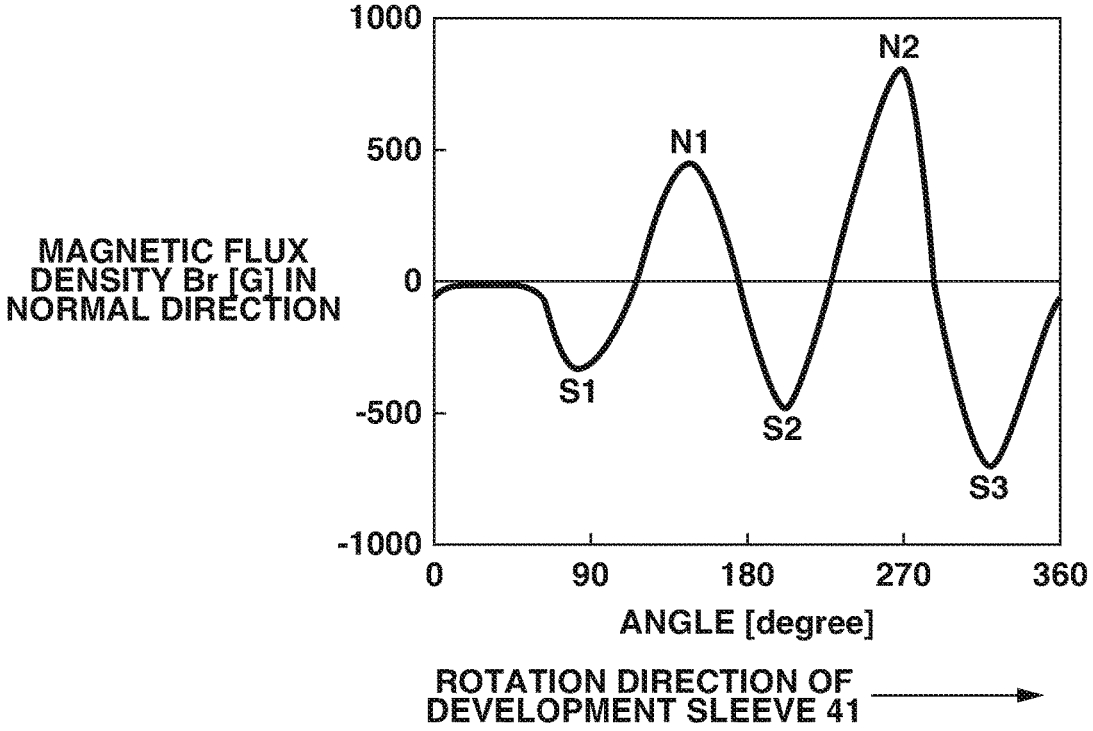
FIG. 5 illustrates a magnetic flux density of a development device according to a second exemplary embodiment.

FIG. 5 illustrates the magnetic flux density Br generated by the magnet roller 42 according to the second exemplary embodiment. In the configuration of the magnetic flux density Br according to the second exemplary embodiment, the functions are interchanged between the poles S2 and N2, when compared with the first exemplary embodiment. The pole N2 is the developing magnetic pole that raises the developer and facilitates the development, and the pole S2 is the conveying magnetic pole that conveys the developer from the regulating magnetic pole N1 to the developing magnetic pole N2.

In the second exemplary embodiment, the magnetic pole that is adjacent to the developing magnetic pole N2 in the downstream direction is the peeling magnetic pole S3, which forms a repulsive magnetic pole. In addition, the peeling magnetic pole S3 has a larger magnetic flux density and full width half maximum and a smaller inter-pole angle from the developing magnetic pole N2 when compared with the conveying magnetic pole S2. In the second exemplary embodiment, of the two magnetic poles S2 and S3 that are adjacent to the developing magnetic pole N2, the downstream magnetic pole S3 has the same magnetic polarity as the magnetic pole S1 adjacent thereto in the downstream direction.

When magnetic poles having the same magnetic polarity are placed adjacent to each other, the magnetic poles exhibit a tendency that the lines of magnetic force are hard to extend to a direction of the poles. Thus, the lines of magnetic force around the peeling magnetic pole S3 cannot extend in the direction of the drawing magnetic pole S1 having the same magnetic polarity and are concentrated in the direction of the developing magnetic pole N2. Owing to this effect, the location where magnetic brushes are raised can be shifted further in the upstream direction, and the development efficiency can be further improved.

However, with the configuration according to the second exemplary embodiment, since the magnetic flux density Br of the peeling magnetic pole S3 is increased, more developer remains at the peeling magnetic pole S3. Consequently, the rotation torque of the sleeve 41 is increased, so that there is a concern that deterioration of the developer could be accelerated. Thus, the magnetic flux density Br of the peeling magnetic pole S3 needs to be determined in view of the balance between a development efficiency improving effect and a rotation torque of the sleeve 41.

Next, a third exemplary embodiment will be described. While a development device 4 according to the third exemplary embodiment has basically the same configuration as the development device 4 according to the first exemplary embodiment, the magnetic pole pattern of a magnet roller 42 serving as a magnetic field generation unit is different.

Figure 6:
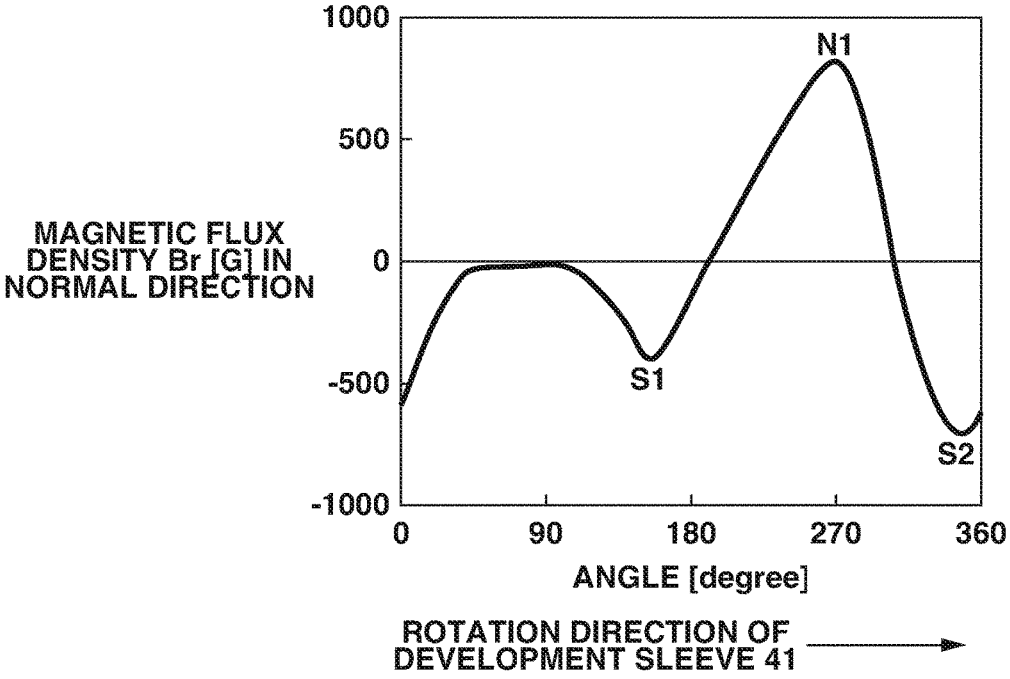
FIG. 6 illustrates a magnetic flux density of a development device according to a third exemplary embodiment.
Figure 7:
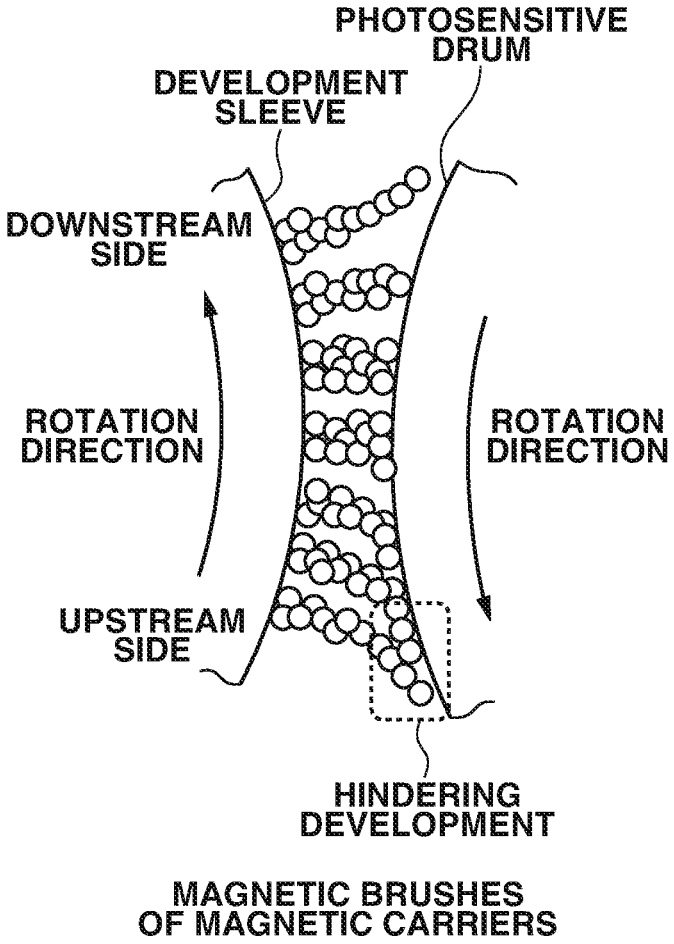
FIG. 7 illustrates a problem to be addressed.

FIG. 6 illustrates the magnetic flux density Br generated by the magnet roller 42 according to the third exemplary embodiment. While the magnetic flux density Br according to the first and second exemplary embodiments has five maximum values, the magnetic flux density Br according to the third exemplary embodiment has only three maximum values. Next, functions of these three maximum values will be described.

The developer adsorbs to a drawing and regulating magnetic pole S1, and the regulation member 43 regulates the layer thickness of the developer. The developer is conveyed to the development area A. At the development area A, the developing magnetic pole N1 forms magnetic brushes of magnetic carriers of the developer and develops an electrostatic latent image on the drum 1. The repulsive force of the peeling magnetic pole S2 and the drawing and regulating magnetic pole S1 forms a peeling area. In addition, the peeling magnetic pole S2 has a larger magnetic flux density and full width half maximum and has a smaller inter-pole angle from the developing magnetic pole N1 than the drawing and regulating magnetic pole S1.

As described above, according to the third exemplary embodiment, the magnet roller 42 serving as the magnetic field generation unit has three magnetic poles S1, N1, and S2, and the developing magnetic pole N1 has a polarity different from the two adjacent magnetic poles S1 and S2.

As described in the second exemplary embodiment, when poles having the same polarity are adjacent to each other, the lines of magnetic force are hard to extend between them. When the contact of the magnetic brushes with the drum 1 is optimized by concentrating the lines of magnetic force, it is not preferable that a magnetic pole upstream of the developing magnetic pole N1 forms a repulsive magnetic field because the lines of magnetic force are concentrated from the upstream direction to the developing magnetic pole N1 and the rising of the magnetic brushes is delayed.

However, according to the third exemplary embodiment, since the peeling magnetic pole S2, which is the downstream magnetic pole, is also a magnetic pole that forms a repulsive magnetic field, the lines of magnetic force are also concentrated from the downstream direction. Accordingly, the effects of the concentration of the lines of magnetic force by the repulsive magnetic fields from the upstream and downstream directions are canceled out. Thus, the peeling magnetic pole S2 is configured to have a larger magnetic flux density and full width half maximum and a smaller inter-pole angle from the developing magnetic pole N1 compared with the drawing and regulating magnetic pole S1. In this way, the rising position of the magnetic brushes of the developer can be shifted in the upstream direction, and the development efficiency improving effect can be achieved.

Since the configuration according to the third exemplary embodiment needs fewer magnet pieces than those according to the first and second exemplary embodiments, the third exemplary embodiment has an advantage of reducing the manufacturing cost of the development device 4.

<Other Matters>

(1) In the above exemplary embodiments, the development sleeve 41 and the drum 1 rotate in the same direction. However, also in a case where the development sleeve 41 and the drum 1 rotates in the opposite direction, the same advantageous effects can be obtained.

(2) The development device according to the present disclosure is also applicable to an image forming apparatus having a configuration other than that of the image forming apparatus illustrated in FIG. 4. The present disclosure is applicable to various types of image forming apparatus, development device, and developer. Specifically, the positional relationship between the development chamber and the agitation chamber (for example, whether they are disposed vertically or horizontally), the shapes of the developer conveyance member and the developer bearing member, and the kinds of toner and carriers are not limited to the above exemplary embodiments.

(3) The latent image bearing member on which a latent image is formed is not limited to a photosensitive member used in an electrophotographic image forming process. A dielectric material used in an electrostatic-recording image forming process, a magnetic material used in a magnetic-recording image forming process, or a member that forms a resistive pattern latent image may be alternatively used. Instead of a rotatable drum, an endless belt traveling around a set of pulleys may be alternatively used.

(4) The present disclosure is also applicable to an apparatus other than a transfer type image forming apparatus. The present disclosure is applicable also to a direct-type image forming apparatus using photosensitive paper or electrostatic recording paper to be conveyed as a latent image bearing member. The present disclosure is applicable also to an image display apparatus that forms a toner image on an image display member as a latent image bearing member.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2017-044775, filed Mar. 9, 2017, which is hereby incorporated by reference herein in its entirety.

What is claimed is:

1. A development device that develops an electrostatic latent image formed on an image bearing member, the development device comprising:

a developer bearing rotatable member configured to bear and convey developer; and a magnetic field generation unit configured to include a first magnetic pole that is fixedly disposed inside the developer bearing member at a position facing the image bearing member, a second magnetic pole that is disposed adjacent to the first magnetic pole at a position upstream of the first magnetic pole in a rotation direction of the developer bearing member and that has a magnetic polarity different from the first magnetic pole, and a third magnetic pole that is disposed adjacent to the first magnetic pole at a position downstream of the first magnetic pole in the rotation direction of the developer bearing member and that has a magnetic polarity different from the first magnetic pole, wherein a maximum value and a full width half maximum of a magnetic flux density of the third magnetic pole in a normal direction of the developer bearing member are larger than a magnetic flux density of the second magnetic pole in the normal direction of the developer bearing member, and wherein a distance between the third magnetic pole and the first magnetic pole is smaller than that between the second magnetic pole and the first magnetic pole.

2. The development device according to claim 1, wherein the position of the maximum value of the magnetic flux density of the first magnetic pole in the normal direction of the developer bearing member is located downstream of the center position of the full width half maximum of the magnetic flux density of the first magnetic pole in the rotation direction.

3. The development device according to claim 1, wherein the magnetic field generation unit further includes a fourth magnetic pole that is disposed adjacent to the third magnetic pole at a position downstream of the third magnetic pole in the rotation direction and that has a magnetic polarity different from the third magnetic pole, and a fifth magnetic pole that is disposed adjacent to the fourth magnetic pole and the second magnetic pole in the rotation direction and has the same magnetic polarity as the fourth magnetic pole.

4. The development device according to claim 1, wherein the magnetic field generation unit includes only the first magnetic pole, the second magnetic pole, and the third magnetic pole.

5. The development device according to claim 1, comprising a regulation member configured to regulate the developer on the developer bearing member, wherein the regulation member is disposed at a position near the second magnetic pole.

6. The development device according to claim 1, when the magnetic field generation unit is seen from a rotation axis direction of the developer bearing member, an outer circumference of the second magnetic pole and the third magnetic pole has a circular shape, and an outer circumference of the first magnetic pole has a straight-line portion.

* * * * *